US012765688B2

(12) United States Patent
Tar et al.

(10) Patent No.: US 12,765,688 B2
(45) Date of Patent: Oct. 20, 2026

(54) ADJUSTABLE BED ASSEMBLY WITH MAGNETIC ATTACHMENT AND METHODS OF MANUFACTURING SAME

(71) Applicant: Tempur World, LLC, Lexington, KY (US)

(72) Inventors: Alanda Marie Tar, Summerfield, NC (US); Darwin Gentile, Greensboro, NC (US); Paul Griese, Versailles, KY (US); Robert Hanson, Greensboro, NC (US); Diane Manuszak, Thomasville, NC (US)

(73) Assignee: TEMPUR WORLD, LLC, Lexington, KY (US)

( * ) Notice: Subject to any disclaimer, the term of this patent is extended or adjusted under 35 U.S.C. 154(b) by 121 days.

(21) Appl. No.: 18/293,198

(22) PCT Filed: Jul. 29, 2022

(86) PCT No.: PCT/US2022/038851

§ 371 (c)(1),
(2) Date: Jan. 29, 2024

(87) PCT Pub. No.: WO2023/009807

PCT Pub. Date: Feb. 2, 2023

(65) Prior Publication Data

US 2024/0374041 A1 Nov. 14, 2024

Related U.S. Application Data

(60) Provisional application No. 63/227,006, filed on Jul. 29, 2021.

(51) Int. Cl.
*A47C 21/02* (2006.01)
*A47C 31/00* (2006.01)

(52) U.S. Cl.
CPC ..... *A47C 21/026* (2013.01); *A47C 31/003* (2013.01)

(58) Field of Classification Search
CPC ... A47C 21/026; A47C 31/003; A47C 27/002; A47C 21/00; A47C 27/02
See application file for complete search history.

(56) References Cited

U.S. PATENT DOCUMENTS 2,995,762 A * 8/1961 Albinson ..... A47C 23/00 5/411
3,049,729 A 8/1962 Broyles
(Continued)

FOREIGN PATENT DOCUMENTS

DE 20 2008 000 249 U1 4/2008
DE 20 2017 000 882 U1 4/2017
JP 2005087668 A 4/2005

OTHER PUBLICATIONS

United States Patent and Trademark Office, International Search Report issued in corresponding Application No. PCT/US2022/038851 mailed Oct. 26, 2022.

*Primary Examiner* — Fredrick C Conley
(74) *Attorney, Agent, or Firm* — Stites & Harbison PLLC; Terry L. Wright

(57) ABSTRACT

A magnetic attachment system includes a magnetic member for securing to the lower surface of a mattress and at least one magnet configured to be secured to the upper surface of the adjustable base. The magnetic member may comprise a magnetic bar or a flexible bar including one or more metal plates positioned at a predetermined location on the flexible bar. A cover may surround the mattress, the cover including a pocket for receiving the magnetic member adjacent to the lower surface of the mattress and defining one or more windows, such that when the magnetic member is received in the pocket, the one or more metal plates are exposed
(Continued)

through the window. An adjustable bed assembly includes a mattress and adjustable base operably connected with the magnetic attachment system.

13 Claims, 10 Drawing Sheets

(56) References Cited

U.S. PATENT DOCUMENTS

| | | | | |
|---|---|---|---|---|
| 3,769,643 | A | 11/1973 | Adler | |
| 4,370,002 | A | 1/1983 | Koepke | |
| 4,541,137 | A | 9/1985 | Murray | |
| 4,726,083 | A | 2/1988 | Hoshall | |
| 4,759,088 | A | 7/1988 | Brown | |
| 4,789,201 | A | 12/1988 | Selbert | |
| 4,899,404 | A | 2/1990 | Galumbeck | |
| 5,005,242 | A | 4/1991 | Kennedy et al. | |
| 5,062,171 | A | 11/1991 | Vrzalik | |
| 5,103,513 | A * | 4/1992 | King | B60N 2/70 5/118 |
| 5,191,664 | A | 3/1993 | Wyatt | |
| 5,195,197 | A * | 3/1993 | Gutierrez | A47C 27/002 5/500 |
| 5,428,852 | A | 7/1995 | Tenuta | |
| 5,499,859 | A | 3/1996 | Angell | |
| 5,991,949 | A | 11/1999 | Miller et al. | |
| 6,233,764 | B1 | 5/2001 | Orr | |
| 6,687,935 | B2 | 2/2004 | Reder et al. | |
| 6,889,396 | B2 * | 5/2005 | Weinman | A47C 21/026 5/613 |
| 7,036,170 | B2 | 5/2006 | Antinori | |
| 7,353,550 | B2 | 4/2008 | Antinori | |
| 7,607,181 | B1 * | 10/2009 | Harrison | A47C 21/026 5/411 |
| 7,832,040 | B2 | 11/2010 | Constantinescu et al. | |
| 11,350,759 | B1 | 6/2022 | Schott et al. | |
| 2001/0042273 | A1 | 11/2001 | Chaffee | |
| 2004/0025258 | A1 | 2/2004 | Van Der Wurf et al. | |
| 2007/0245495 | A1 | 10/2007 | Wang | |
| 2010/0154118 | A1 | 6/2010 | Pearce | |
| 2013/0042412 | A1 * | 2/2013 | Shih | A47C 20/04 5/693 |
| 2013/0302085 | A1 * | 11/2013 | King | A47B 87/002 403/188 |
| 2016/0206489 | A1 * | 7/2016 | Rawls-Meehan | A47C 21/026 |
| 2018/0125260 | A1 * | 5/2018 | Peterson | A47C 27/10 |

* cited by examiner

ADJUSTABLE BED ASSEMBLY WITH MAGNETIC ATTACHMENT AND METHODS OF MANUFACTURING SAME

RELATED APPLICATIONS

This application claims priority from U.S. Provisional Application Ser. No. 63/227,006, filed Jul. 29, 2021, the entire disclosure of which is incorporated herein by this reference.

TECHNICAL FIELD

The present invention relates to an adjustable bed assembly. In particular, certain embodiments of the present invention relate to an adjustable bed assembly that makes use of a magnetic attachment system to secure a mattress to an adjustable base.

BACKGROUND

Bed assemblies that make use of adjustable bases are becoming increasingly popular as an alternative to traditional bed assemblies. Unlike traditional bed assemblies that make use of rigid box springs or other similar bases, a bed assembly that makes use of an adjustable base can readily be adjusted by articulating the base into a desired ergonomic position. In other words, by articulating the adjustable base, a user can readily change the position of the mattress lying on the adjustable base and, consequently, can quickly match the position of the mattress to their specific preferences and, at least partially, individualize his or her level of sleep comfort.

Despite the readily adjustable nature of such bed assemblies, the use of adjustable bases frequently leads to difficulties in manipulating the mattresses lying on top of the bases. More particularly, in a bed assembly that makes use of an adjustable base, the adjustable base often includes a retainer bar rigidly secured to the foot of the base that holds the mattress firmly in position atop the base and prevents the mattress from sliding off of the base when it is articulated. In using such a rigid retainer bar, however, the retainer bar also acts to prevent the mattress from easily being manipulated, such as what may be necessary to rotate the mattress or change the sheets covering the mattress. Moreover, and in addition to the undesirable aesthetics of using a large metal retainer bar at the foot of a bed, bed assemblies that make use of such retainers bars in conjunction with an adjustable base frequently exhibit undesirable mattress bridging where the mattress separates from the underlying base when it is articulated. Such bed assemblies also frequently have the mattress itself breach and extend over the retainer bar. Accordingly, improved adjustable bed assemblies capable of securing a mattress to an adjustable base without the undesirable aesthetics and other issues encountered with the use of retainer bars would be both highly desirable and beneficial.

SUMMARY

The present invention includes an adjustable bed assembly and a magnetic attachment system. In particular, certain embodiments of the present invention include an adjustable bed assembly that makes use of a magnetic attachment system to secure a mattress to an adjustable base.

In one exemplary embodiment of the present invention, the adjustable bed assembly includes a mattress having a lower surface, an adjustable base having an upper surface, and one or more magnetic attachment systems. Each magnetic attachment system includes a magnetic member for securing to the lower surface of the mattress and at least one magnet configured to be secured to the upper surface of the adjustable base.

In some exemplary embodiments, the one or more magnetic attachment systems includes a first magnetic attachment system positioned adjacent to an upper or central portion of the mattress and the adjustable base and a second magnetic attachment system positioned adjacent to a foot portion of the mattress and the adjustable base In some exemplary embodiments, the one or more magnetic attachment systems comprise at least two sets of magnets.

In some exemplary embodiments, the at least one magnet defines a central opening, and the at least one magnet is secured to the adjustable base using a fastener positioned through the central opening.

In some exemplary embodiments, a plastic shell is positioned around the at least one magnet, a metal ring is positioned around the at least one magnet, or both a plastic shell and a metal ring are positioned around the at least one magnet.

In some exemplary embodiments, the mattress includes a pocket for receiving the magnetic member adjacent to the lower surface of the mattress. In some particular embodiments, a cover surrounds the mattress, and the cover includes a pocket for receiving the magnetic member adjacent to the lower surface of the mattress.

In some exemplary embodiments, the magnetic member comprises a magnetic bar. In other exemplary embodiments, the magnetic member comprises a flexible bar including one or more metal plates positioned at a predetermined location on the flexible bar. In some particular embodiments which also include a pocket for receiving the magnetic member, the pocket defines one or more windows which each correspond to the predetermined location of the one or more metal plates, such that when the magnetic member is received in the pocket, the one or more metal plates are exposed through the window.

In some exemplary embodiments, at least one magnet housing is included which is configured to be secured to the upper surface of the adjustable base. Each magnet housing includes a central channel configured to receive the magnetic member, and one or more magnets positioned in the central channel of the at least one magnet housing.

In some exemplary embodiments, the mattress is a flexible foam mattress. In some particular embodiments, the flexible foam is a visco-elastic foam.

Further features and advantages of the present invention will become evident to those of ordinary skill in the art after a study of the description, figures, and non-limiting examples in this document.

DESCRIPTION OF EXEMPLARY EMBODIMENTS

Figure 1:
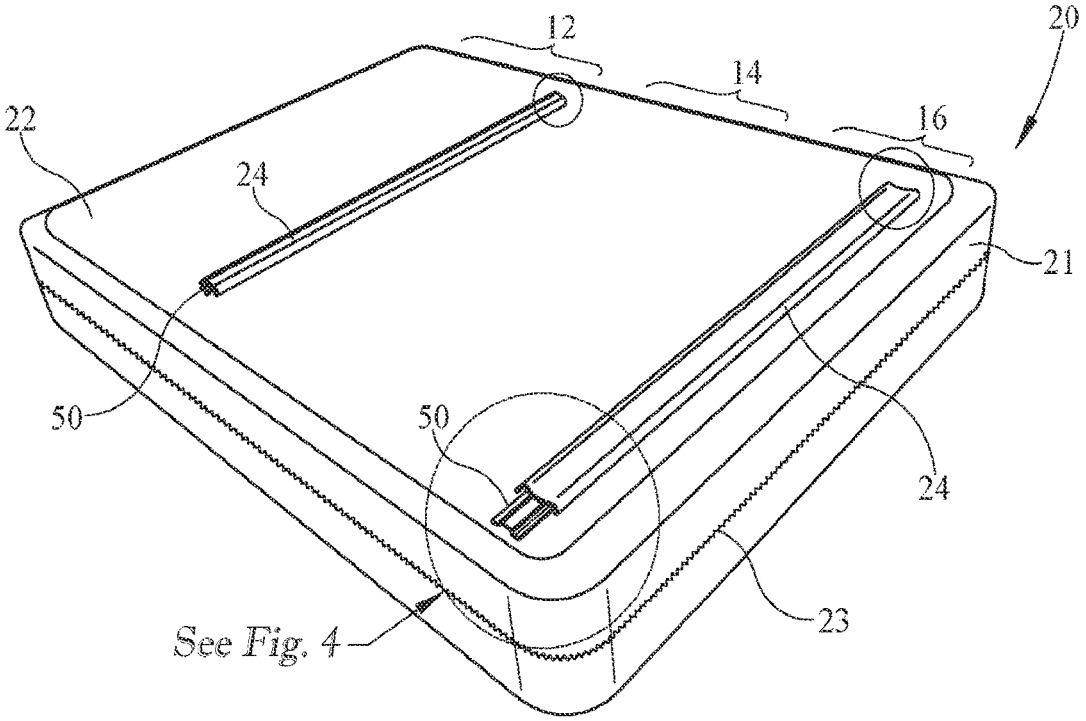
FIG. 1 is a perspective view of a mattress included in an adjustable bed assembly made in accordance with the present invention, and showing two magnetic members in the form of magnetic bars positioned in pockets of a cover on the lower surface of the mattress.

The present invention includes an adjustable bed assembly and a magnetic attachment system. In particular, certain embodiments of the present invention include an adjustable bed assembly that makes use of a magnetic attachment system to secure a mattress to an adjustable base.

Referring first generally to FIGS. 1-6, in one exemplary embodiment of the present invention, an adjustable base assembly is provided that includes a mattress 20 (shown in FIG. 1) having a lower surface 22 and an adjustable base 30 (shown in FIG. 2) having an upper surface 32, such that when the mattress 20 is positioned on the adjustable base 30, the lower surface 22 of the mattress 20 is positioned atop and in contact with the upper surface 32 of the adjustable base 30. The mattress 20 is generally comprised of a flexible foam, which may include, but is not limited to, flexible foams such as: latex foam; reticulated or non-reticulated visco-elastic foam (sometimes referred to as memory foam or low-resilience foam); reticulated or non-reticulated non-visco-elastic foam; high-resilience polyurethane foam; expanded polymer foams (e.g., expanded ethylene vinyl acetate, polypropylene, polystyrene, or polyethylene); and the like. In the exemplary embodiment shown in FIGS. 1-6, for example, the mattress is comprised of a visco-elastic foam that has a low resilience, but sufficient hardness and density so that pressure is distributed evenly across the mattress 20.

Regardless of the particular type of materials (e.g., the foams) used in an exemplary mattress, when the mattress 20 is placed on the adjustable base 30, and the adjustable base 30 is articulated, the weight of the mattress 20 and/or the weight of a user lying on the mattress 20 has the potential to cause the mattress 20 to slide downward across the upper surface 32 of the adjustable base 30. To prevent such movement of the mattress 20 relative to the adjustable base 30, the adjustable bed assembly of the present invention includes a magnetic attachment system 40 that is comprised of a magnetic member 50 secured to the lower surface 22 of the mattress 20, which are shown connected in FIGS. 3 and 6. As used herein, the term "magnetic" refers a material which is attracted to a magnetic field. The exemplary magnetic member 50 is comprised of a ferromagnetic material, but other materials are contemplated for use in the magnetic member of the present invention including, in some embodiments, permanent magnets or electromagnets. The magnetic attachment system 40 further includes a magnet housing 60 that is secured to the upper surface 32 of the adjustable base 30 and one or more magnets 70 that are positioned in the magnet housing 60. As discussed further below, the exemplary one or more magnets 70 are permanent magnets, but it is contemplated that in some other embodiments the magnets secured to the adjustable base are electromagnets. Regardless of the particular type of magnetic member and magnets utilized, when the mattress 20 is placed atop the upper surface 32 of the adjustable base 30, the magnetic member 50 is placed adjacent to the magnets 70 in each magnet housing 60 positioned on the lower surface 22 of the mattress 20, such that the mattress 20 is secured to the adjustable base 30 and is prevented from sliding relative to the adjustable base 30. Accordingly, the form and configuration of the magnetic member and the magnets are each chosen to provide sufficient attraction to secure the mattress 20 to the adjustable base 30 and prevent sliding.

Figure 2:
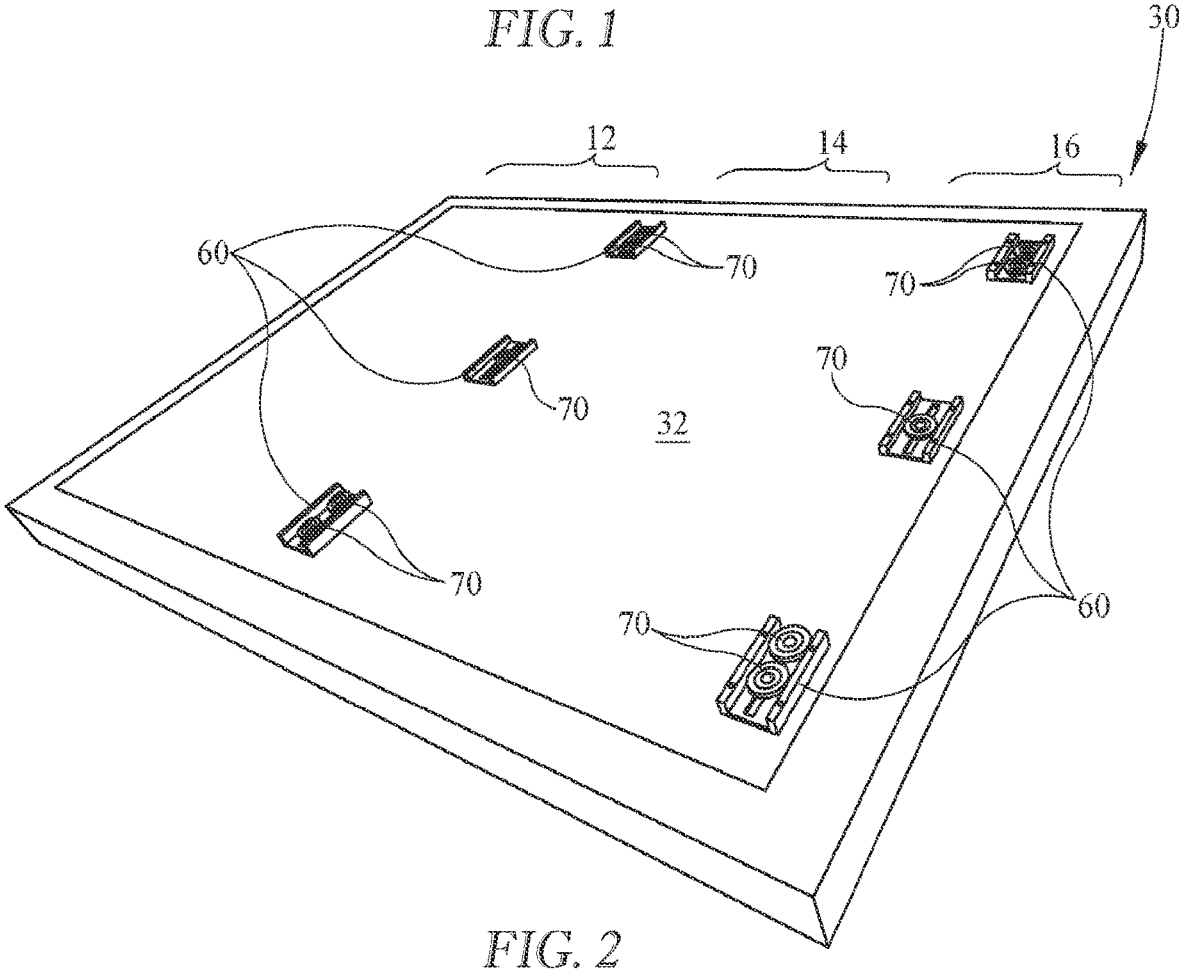
FIG. 2 is a perspective view of an adjustable base included in an adjustable bed assembly made in accordance with the present invention, and showing a plurality of magnet housings secured to the upper surface of the adjustable base with one or more magnets positioned in a central channel of each magnet housing.
Figure 3:
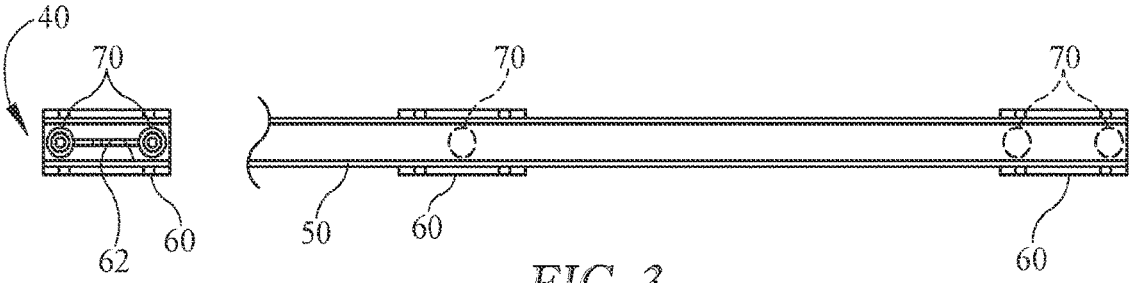
FIG. 3 is a top view of a magnetic attachment system made in accordance with the present invention shown in isolation with one of the magnetic bars of FIG. 1 engaging three of the magnet housings of FIG. 2.

In the exemplary adjustable bed assembly, and referring now specifically to FIGS. 1-2, to effectively secure the mattress 20 to the adjustable base 30, the adjustable base assembly includes a first magnetic attachment system 40 that is positioned between the upper portion 12 and the central portion 14 of the adjustable base assembly, and a second magnetic attachment system 40 that is positioned adjacent to the foot portion 16 of the adjustable base assembly. Further, in this exemplary embodiment, each magnetic attachment system 40 is comprised of a single magnetic member 50 and three magnet housings 60 with each magnet housing 60 including either one or two magnets 70. Of course, it is contemplated that additional or alternative magnetic attachment assemblies, including different numbers of magnetic members or different numbers of magnet housings and/or magnets can also readily be incorporated into an exemplary adjustable bed assembly without departing from the spirit and scope of the present invention. For example, in certain embodiments, greater than two magnet members and/or greater than three magnet housings and accompanying magnets may be included in an exemplary adjustable bed assembly to secure a larger mattress (e.g., a king size) to an adjustable base. Alternatively, in other embodiments, less than two magnet members and/or less than three magnet housings and accompanying magnets may be included in an exemplary adjustable bed assembly to secure a smaller mattress (e.g., a twin size) to an adjustable base.

Figure 4:
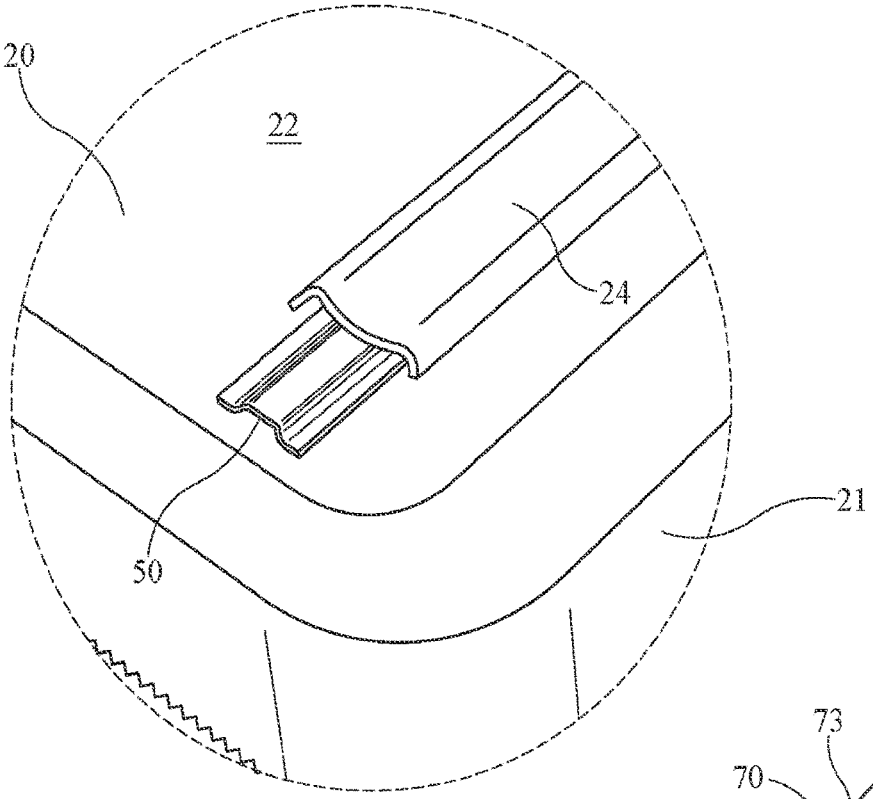
FIG. 4 is a detailed view of the portion identified in FIG. 1 with the magnetic bar partially removed from the pocket on the cover on the lower surface of the mattress.

Referring now to FIGS. 1 and 4, the magnetic member 50 in this exemplary embodiment is in the form of an elongated, solid metal bar that is secured to the lower surface 22 of the mattress 20 by sliding the magnetic member 50 in a pocket 24 on a cover 21 surrounding the mattress 20. The exemplary cover 21 includes a zipper 23 which allows the cover 21 to be removed from the mattress 20 such that the magnetic attachment system 40 can be utilized without requiring any modification to the mattress 20. However, it is contemplated that in other embodiments the cover is part of the mattress itself such that that the pocket 24 is formed directly on a lower surface of the mattress. Although not expressly shown, in some other embodiments, the magnetic member can be affixed directly to the mattress itself without the use of a pocket. In such embodiments, a cover, or other fabric layer, may still be provided over the magnetic member itself.

Regardless of the particular configuration of the cover 21, in this embodiment, the pocket 24 completely surrounds and envelopes the magnetic member 40 to secure it to the cover 21. As discussed further below, in other embodiments, however, it is contemplated that the pocket can surround only certain portions of a magnetic member to secure it to the cover, but leave other portions of magnetic member exposed to thereby allow for more direct contact between the magnetic member and the magnet housings and associated magnets of an exemplary magnetic attachment system. For example, the pocket can be in the form of a segmented sleeve with separate and distinct sections that surround and secure the magnetic member, or as discussed below with reference to FIGS. 13-17, the pocket can define windows that expose portions of the magnetic member.

Figure 5:
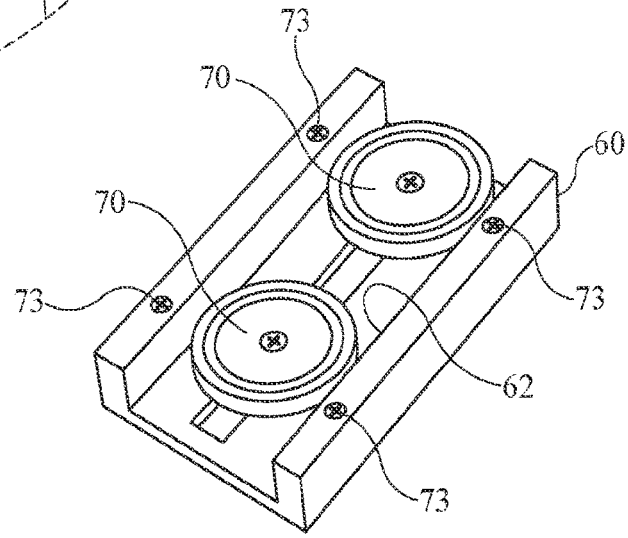
FIG. 5 is a perspective view of one magnet housing of FIG. 1 shown in isolation, with the magnet housing including two magnets positioned in the central channel of the magnet housing.
Figure 6:
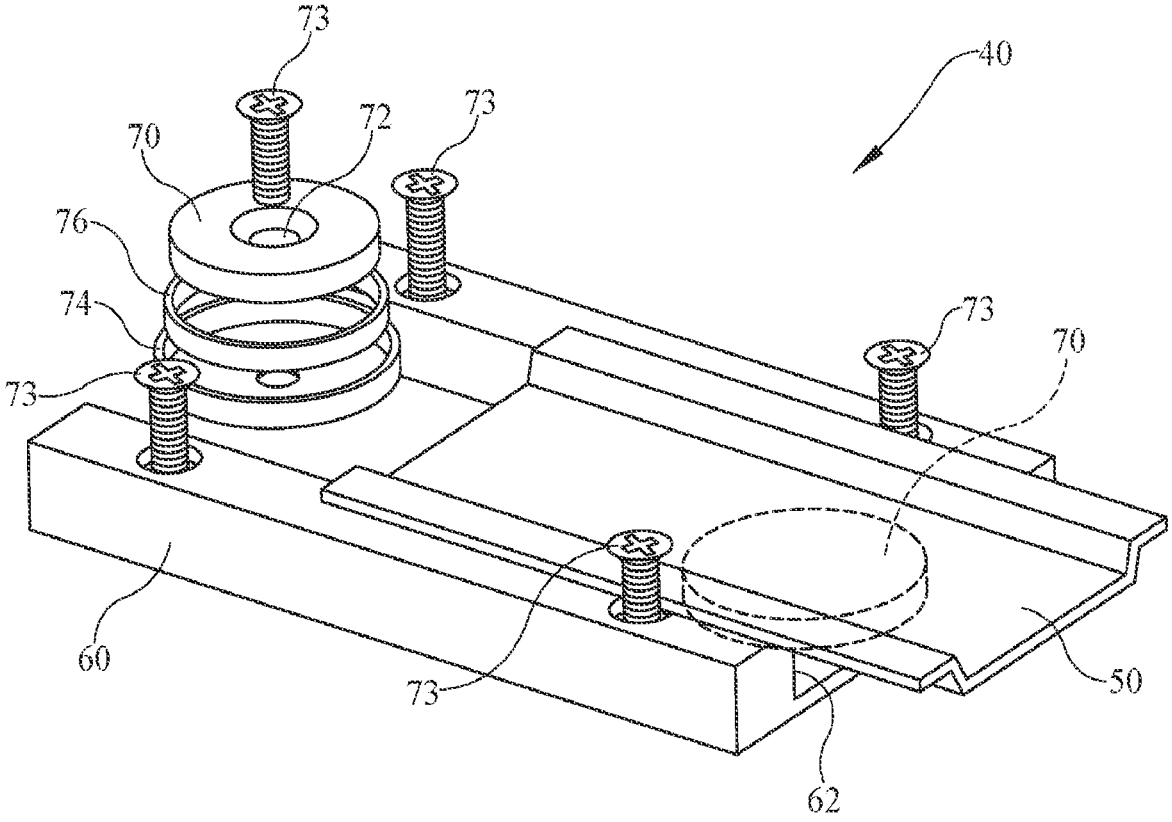
FIG. 6 is a partially exploded perspective view of the magnetic attachment system shown in FIG. 3 illustrating the connection between one magnetic bar and one magnet housing.

With regard to the magnet housing, and referring now to FIGS. 2, 3, 5 and 6, the magnet housing 60 is generally comprised of a sufficiently hard plastic material (e.g., polypropylene) or other non-magnetic material and is secured directly to the upper surface 32 of the adjustable base 30 using a number of fasteners 73 (e.g., screws) that extend through raised portions on either side of the magnet housing 60, as perhaps best shown in FIGS. 5-6. In this way, the magnet housing 60 then defines a central channel 62 that extends the length of the magnet housing 60 and that has a width sufficient to receive and secure the magnetic member 50 within the central channel 62 and against the magnets 70.

With regard to the magnets 70 themselves, and as perhaps bet shown in FIG. 6, the magnets 70 each define a central opening 72 that allows the magnets 70 to be secured to the magnet housing 60 and the underlying adjustable base 30 by placing a suitable fastener 73 through the central opening 72. To reduce non-specific interactions between magnetic objects and the magnets 70, a plastic shell 74 and a metal ring 76 is further placed around the magnets 70, and is held in place by virtue of the magnet 70 being secured to the magnet housing 60 and the underlying adjustable base 30 with the fastener 73. In this regard, in the exemplary magnetic attachment system 40, the magnets 70 are neodymium magnets with up to two magnets 70 included in each magnet housing 60 in order to allow the magnetic attachment system 40 to have sufficient strength to secure the mattress 20 against the adjustable base 30. It is further contemplated though that different arrangements, including different types and numbers of magnets, can also be readily included in an exemplary magnet housing and magnetic attachment assembly as needed for a particular application.

Figure 7:
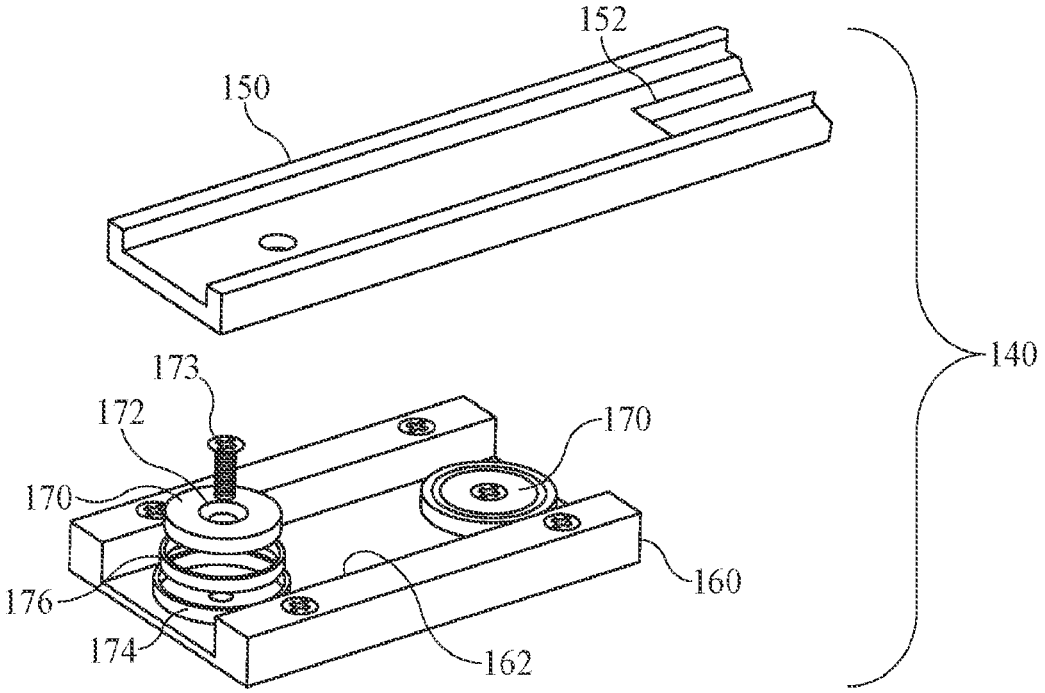
FIG. 7 is a partially exploded perspective view of another magnetic attachment system made in accordance with the present invention.
Figure 8:
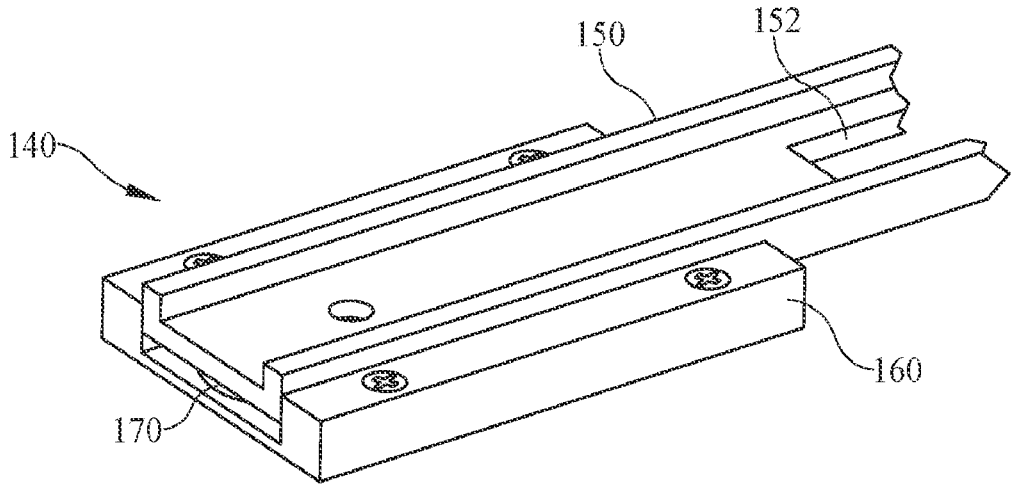
FIG. 8 is a perspective view showing the magnetic attachment system of FIG. 7 in assembled form.

As a refinement, and referring now to FIGS. 7-8, in another embodiment of the present invention, a magnetic attachment system 140 is provided that, similar to the magnetic attachment system 40 shown in FIGS. 1-6, includes a magnet housing 160 including a central channel 162. The magnetic attachment system 140 further includes a magnet 170 that is secured to the magnet housing 160 using a fastener 173 inserted through a central opening 172 in the magnet 170 and that is surrounded by a plastic shell 174 and a metal ring 176. Unlike the magnetic attachment system 40 shown in FIGS. 1-7, however, the magnetic member 150 included in the magnetic attachment system 140 is not an elongated, solid metal bar. Rather the magnetic member 150 is an elongated metal bar having one or more lightening holes 152 that serve to reduce the weight of the magnetic member 150.

Figure 9:
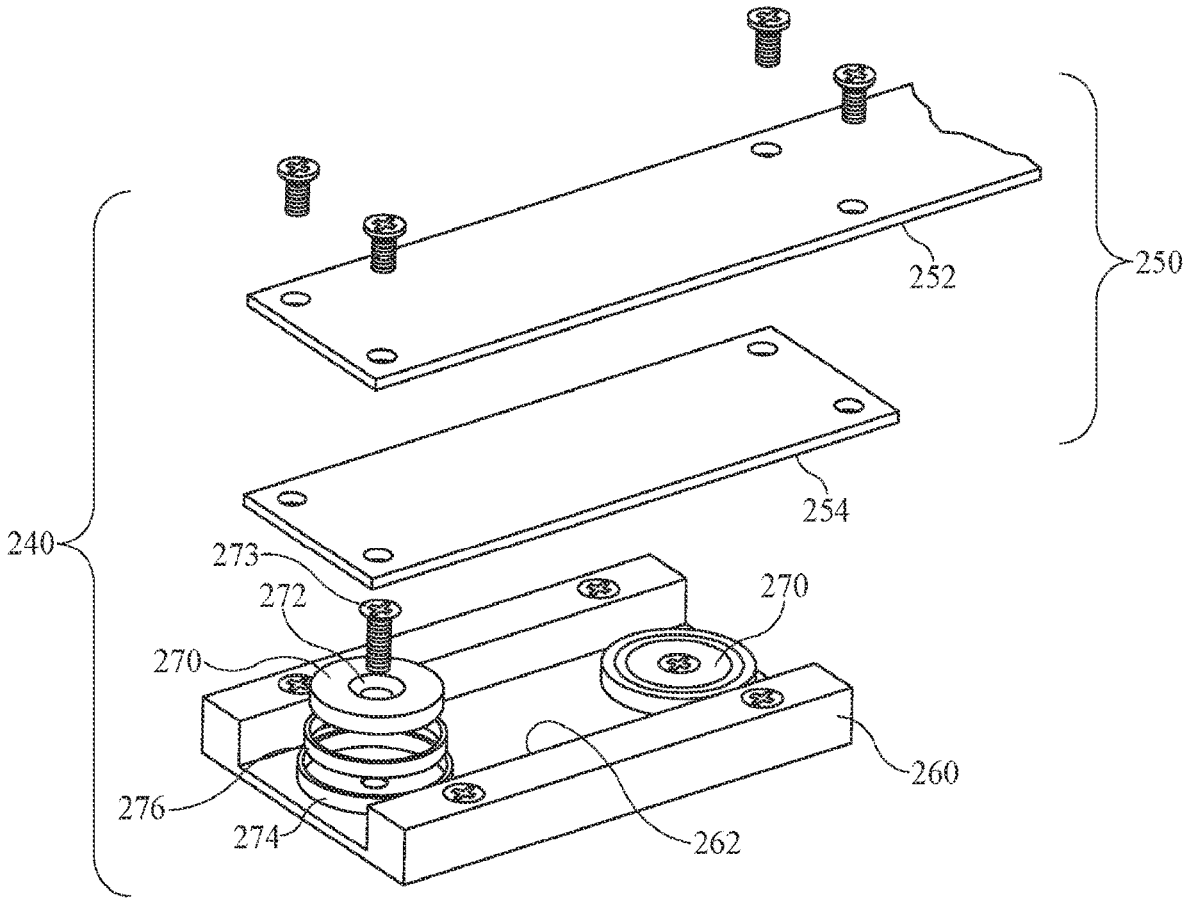
FIG. 9 is a partially exploded perspective view of another magnetic attachment system made in accordance with the present invention.
Figure 10:
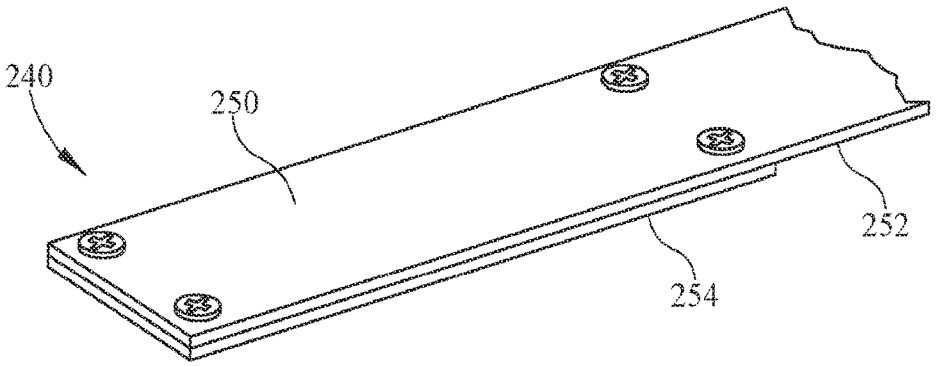
FIG. 10 is a perspective view showing part of the magnetic attachment system of FIG. 9 in assembled form.
Figure 11:
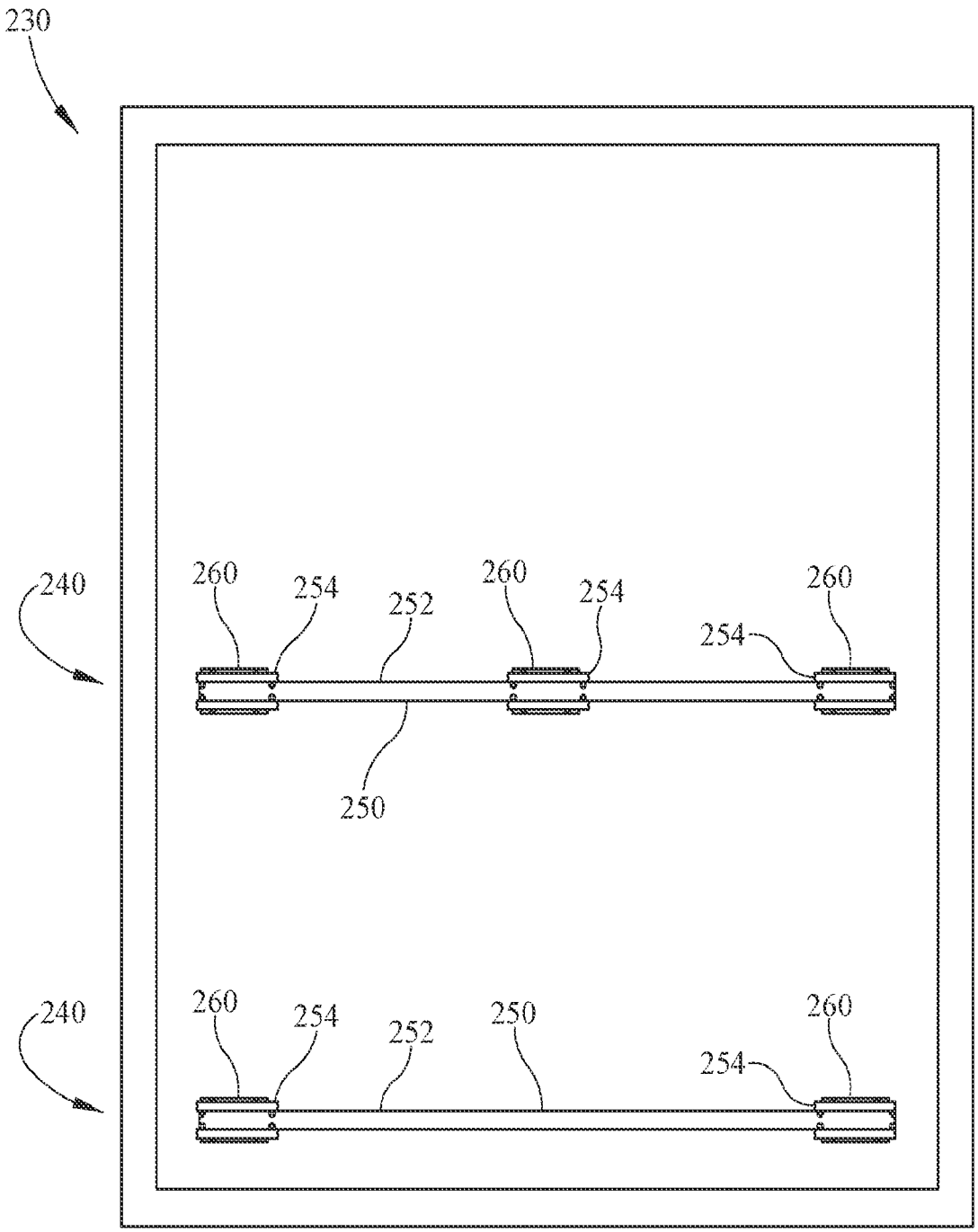
FIG. 11 is a top view of an adjustable base included in an adjustable bed assembly made in accordance with the present invention, and showing two of the magnetic attachment systems of FIG. 9 in operation.

As an even further refinement, and referring now to FIGS. 9-11, in a further embodiment of the present invention, another magnetic attachment system 240 is provided that, similar to those shown in FIGS. 1-8, also includes a magnet housing 260 having a central channel 262 and a magnet 270 that is secured to the magnet housing 260 using a fastener 273 inserted through a central opening 272 in the magnet 270 and that is surrounded by a plastic shell 274 and a metal ring 276. In the magnetic attachment system 240, however, the magnetic member 250 is not solely comprised of a single piece of metal. Rather, the magnetic member 250 is comprised of multiple materials and, more specifically, is comprised of a bar 252 made of a flexible plastic material (e.g., polyethylene) with one or more metal plates 254 positioned at predetermined locations along the length of the flexible bar 252. In this way, and as shown in FIG. 11, upon assembly of an exemplary adjustable bed assembly, the metal plates 254 are thus positioned on the flexible bar 252 in a manner that allows the metal plates 254 to align with the location of the underlying magnet housings 260 and magnets 270 connected to the adjustable base 230. Further, by making the flexible bar 252 from a flexible plastic material, the flexible bar 252 thus acts to not only reduce the weight of the magnetic attachment system 240, but further incorporates an amount of flexibility into the system to allow the mattress of an exemplary adjustable bed assembly to more easily be released from the underlying adjustable base. Although the embodiment shown in FIGS. 9-11 utilizes fasteners (e.g., screws) to secure the metal plates 254 to the flexible bar 252 any number of means of fastening are contemplated including gluing, welding, molding, overmolding, etc.

Figure 12:
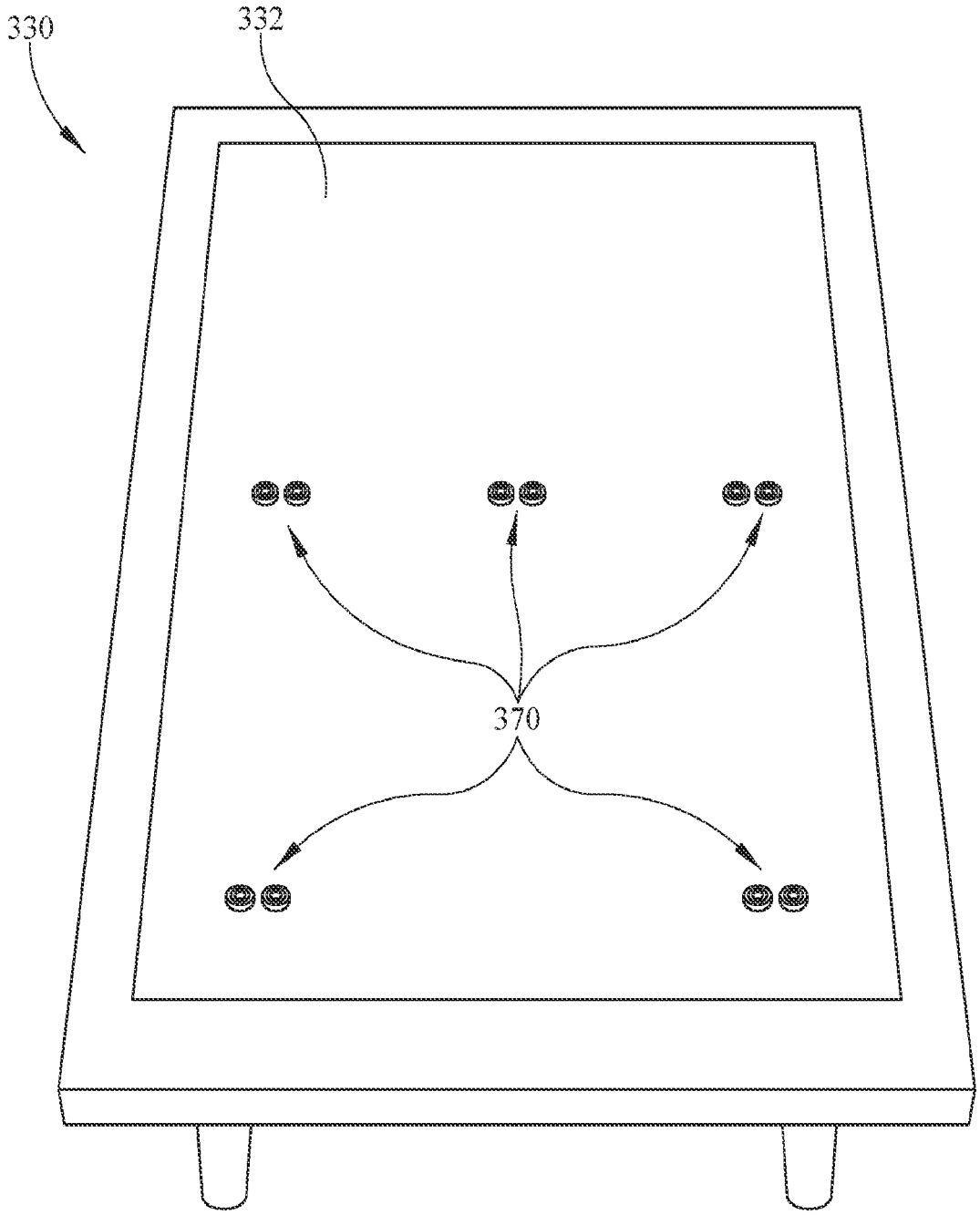
FIG. 12 is a perspective view of another adjustable base included in an adjustable bed assembly made in accordance with the present invention, in which a plurality of magnets are directly secured to the upper surface of the adjustable base without an intervening magnet housing.

While each of the magnetic attachment systems 40, 140, 240 discussed above includes a magnet housing 60, 160, 260 in which the magnets 70, 170, 270 are positioned, according to some other embodiments, and referring now to FIG. 12, the magnets 370 are attached directly to the upper surface 332 of the adjustable base 330. In this exemplary embodiment, the magnets 370 are positioned in groups of two with three sets of magnets 370 aligned to engage one magnetic member (not shown) and two sets of magnets 370 aligned to engage another magnetic member (not shown). Of course, the particular number and placement of the magnets 370 is not limited. Regardless of the number or placement, the exemplary magnets 370 are configured similar to the magnets 70, 170, 270 discussed above with a central opening that allows the magnets 370 to be secured to the adjustable base 330 and a plastic shell and a metal ring are further placed around the magnets 370.

Figure 17:
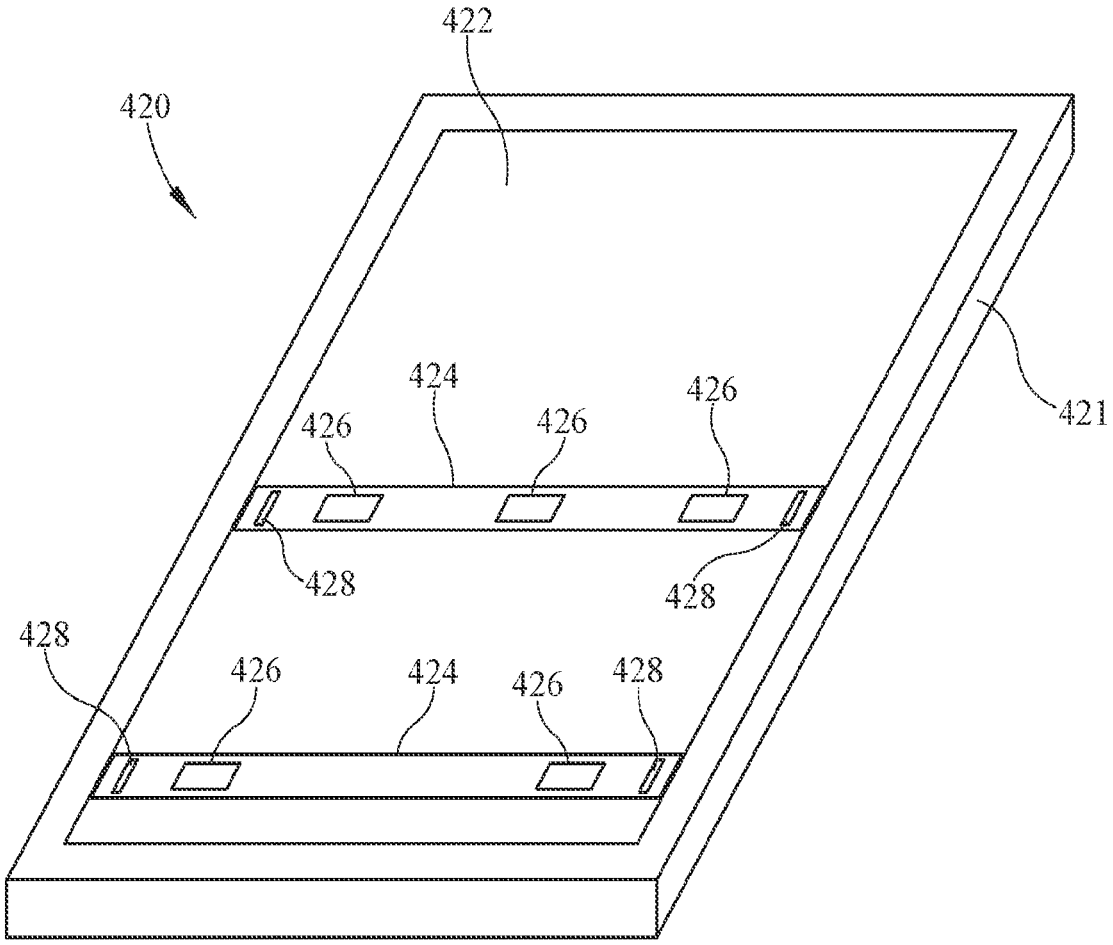
FIG. 17 is a perspective view of another mattress with a cover including the fabric panel of FIG. 16 adjacent to the lower surface of the mattress.

Referring now to FIG. 17, in another exemplary embodiment of the present invention, a mattress 420 is provided that, similar to the mattress 20 shown in FIG. 1, includes a cover 421 with pockets 424 which is used to secure a magnetic member (not shown) to the cover 421 at the lower surface 422 of the mattress 420. Each pocket 424 defines an access holes 428 at either end of the pocket 424 which allow for a magnetic member, e.g., one of the magnetic members 50, 150, 250 discussed above, to be inserted into the pocket 424. Furthermore, and as previously mentioned, while the exemplary pocket 424 surrounds certain portions of a magnetic member to secure it to the cover, the pocket 424 leaves other portions of magnetic member exposed to thereby allow for more direct contact between the magnetic member and the associated magnets of an exemplary magnetic attachment system. To this end, each pocket 424 shown in FIG. 17 also includes a plurality of windows 426 that expose portions of a magnetic member inserted into the pocket 424. In some embodiments, the locations of the windows 426 correspond to the predetermined location of the metal plates positioned at predetermined locations along the length of a flexible bar such that when the magnetic member is received in the pocket, the one or more metal plates are exposed through the window.

According to some exemplary methods of the present invention, and with reference to the exemplary mattress 20 shown in FIG. 1, the pockets 24 which receive the magnetic members 50 are formed by sewing the pockets 24 onto the cover 21 so as to be adjacent to the lower surface 22 of the mattress 20. According to this method, and as perhaps best shown in FIG. 4, the resulting pockets 24 have open ends which allow the magnetic member 50 to slide into the pocket 24. However, in some other embodiments, and referring now to FIGS. 13-17, the pockets are formed by folding a single fabric panel to create loops and then sewing the panel along these folds to close the loops and form the pockets. Advantageously, these "fold and sew" pockets provide a pivot axis which allows the mattress to better conform to the adjustable base as the adjustable base articulates. Furthermore, allowing for the pocket to pivot about the sew line reduces wear to the pocket during the lifespan of the mattress.

Figure 13:
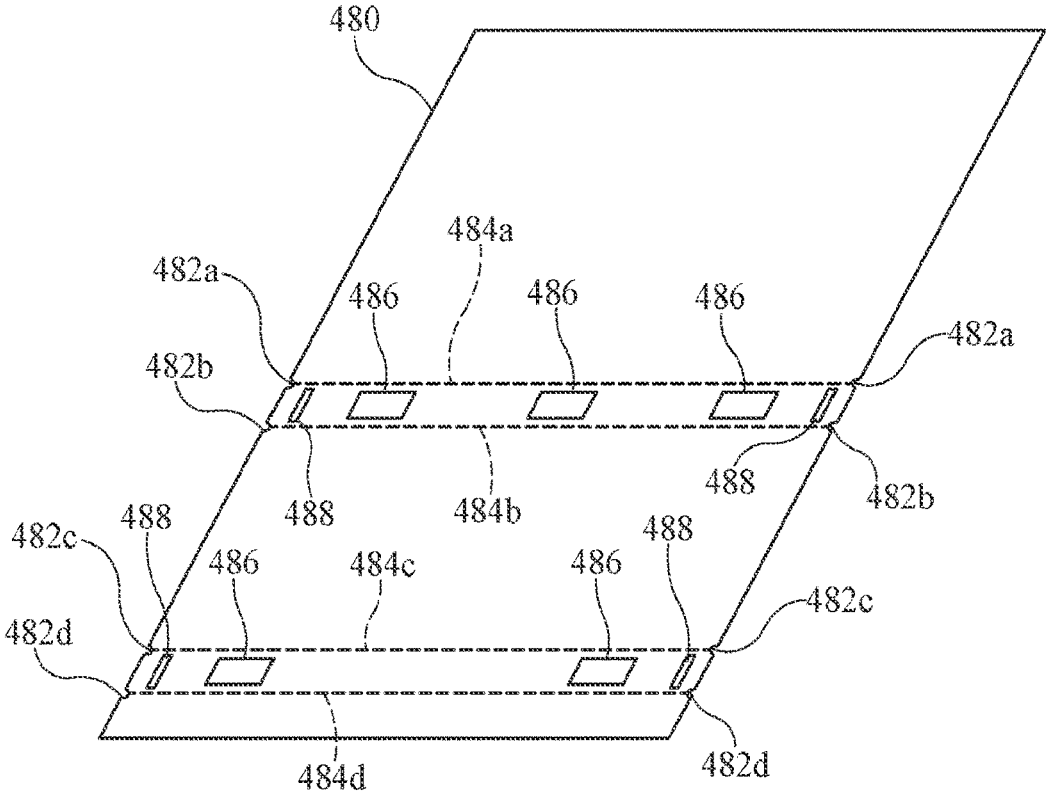
FIG. 13 is a perspective view of a fabric panel used in the manufacture of a mattress cover with pockets for receiving magnetic members.

In one exemplary method of forming such a "fold and sew" pocket, and referring specifically to FIG. 13, a fabric panel 480 is first provided which includes four sets of notches 482*a*-482*d* along the sides of the fabric panel 480. These notches 482*a*-482*d* help with the alignment of corresponding stitching lines 484*a*-484*d* which extend across the fabric panel 480, as discussed further below. It should be understood that the stitching lines 484*a*-484*d* are not necessarily visible, but rather an imaginary line extending across the transverse axis of the fabric panel 480 between corresponding notches 482*a*-482*d*. The fabric panel 480 also defines a plurality of large cutouts 486 and a plurality of small cutouts 488 which are each bordered by two of the stitching lines 484*a*-484*d*.

Figure 14:
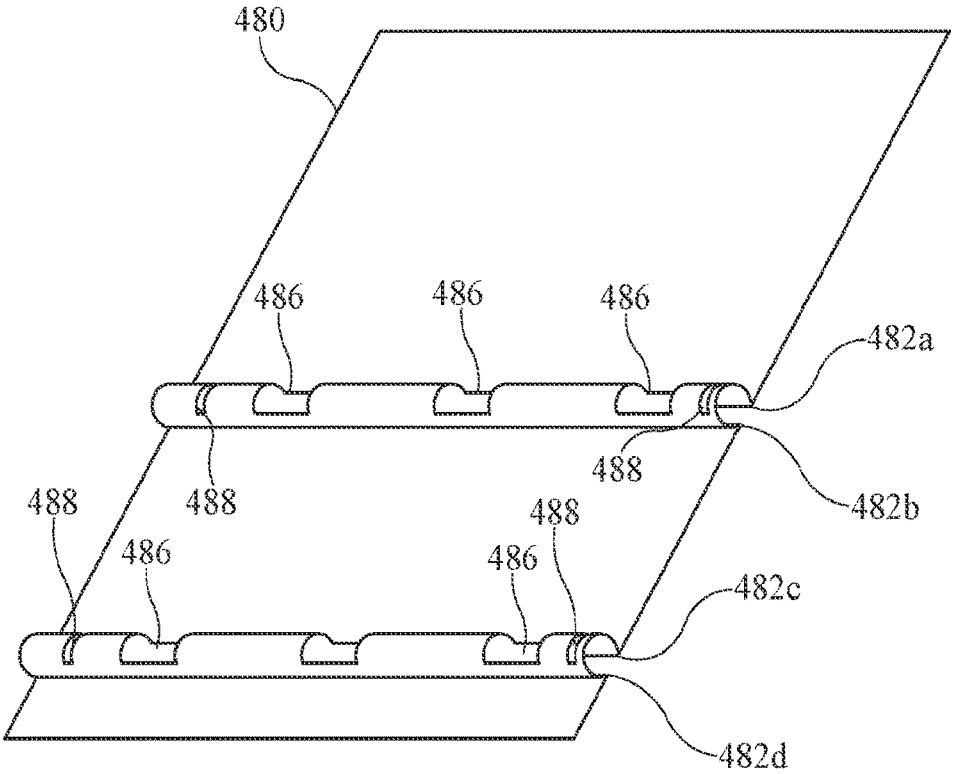
FIG. 14 is a perspective view of the fabric panel of FIG. 13 beginning to be folded to form loops.

Referring now to FIG. 14, the fabric panel 480 is folded to bring the two upper sets of stitching lines 484*a*, 484*b* (shown in FIG. 13) towards each other to begin forming a first loop and likewise to bring the two lower sets of stitching lines 484*c*, 484*d* (shown in FIG. 13) towards each other to begin forming a second loop. As previously mentioned, in some embodiments the stitching lines 484*a*-484*d* are imaginary and not actually visible. To this end, it is contemplated that the notches 482*a*-482*d* provide the necessary visual and physical identification points to ensure that the loops are appropriately sized and positioned.

Figure 15:
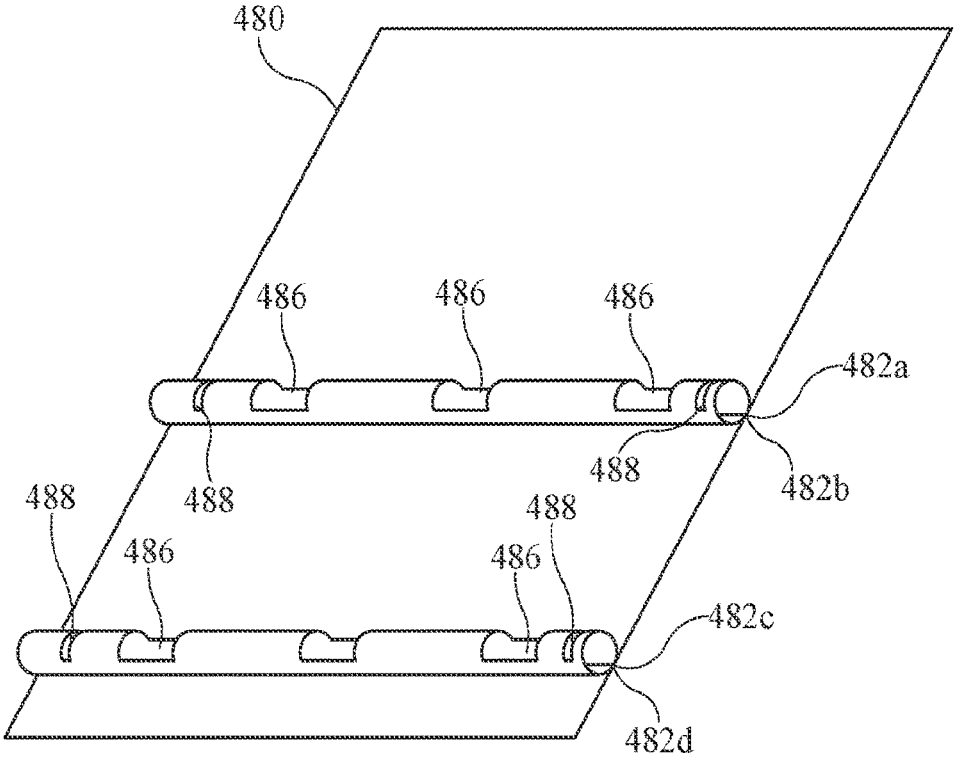
FIG. 15 is a perspective view of the fabric panel of FIG. 14 but further folded to complete the loops which are stitched to form pockets.

Referring now to FIG. 15, folding of the fabric panel 480 is continued until the first loop is completed (i.e., a first set of notches 482*a* are adjacent to a second set of notches 482*b*) and the fabric panel 480 stitched along the now touching stitching lines 484*a*, 484*b* (shown in FIG. 13) to form a first pocket 424. Likewise, the second loop is completed (i.e., a third set of notches 482*c* are adjacent to a fourth set of notches 482*d*) and the fabric panel 480 is stitched along the now touching stitching lines 484*c*, 484*d* (shown in FIG. 13) to form a second pocket 424.

Figure 16:
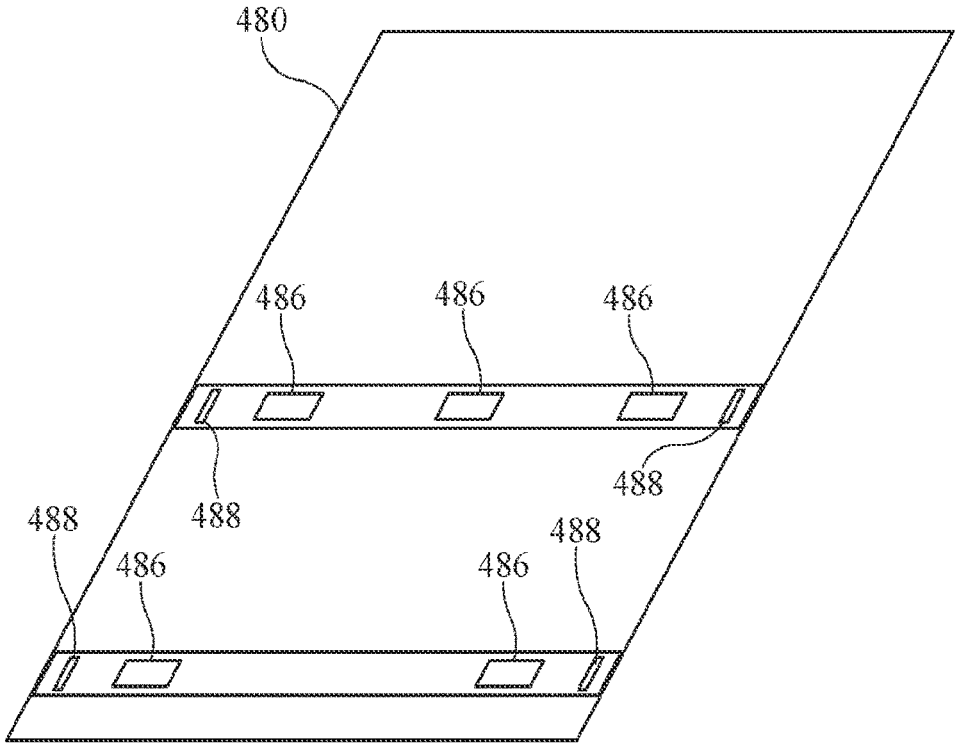
FIG. 16 is a perspective view of the fabric panel of FIG. 15 but with the pockets flattened to allow for insertion of the magnetic member.

Referring now to FIG. 16, the pockets 424 are then flattened to allow for later insertion of the magnetic member, as discussed further below.

Referring once again to FIG. 17, the fabric panel 480 is incorporated into a cover 421 which surrounds a mattress 420 with the fabric panel 480 adjacent to a lower surface 422 of the mattress 420. Specifically, the ends of the pockets 424 are closed, for example by sewing an additional piece of fabric, or binding, around the perimeter of the fabric panel 480 in the process of forming the cover 421. To this end, the plurality of small cutouts 488 in the fabric panel 480 form the access holes 428 which allow for a magnetic member (e.g., magnetic members 50, 150, 250 discussed above) to be inserted into the pocket 424. The large cutouts 486 likewise form the windows 426 that expose portions of the magnetic member inserted into the pocket 424.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. An adjustable bed assembly, comprising:

a mattress having a lower surface;

an adjustable base having an upper surface; and one or more magnetic attachment systems, each magnetic attachment system including a magnetic member for securing to the lower surface of the mattress, the magnetic member comprising a magnetic bar, at least one magnet configured to be secured to the upper surface of the adjustable base, and a plastic shell positioned around the at least one magnet, a metal ring positioned around the at least one magnet, or both a plastic shell and a metal ring positioned around the at least one magnet, and at least one magnet housing configured to be secured to the upper surface of the adjustable base, each magnet housing including a central channel configured to receive the magnetic member, the central channel extending a length of the magnet housing and having a width sufficient to receive and secure the magnetic bar within the central channel, and the at least one magnet positioned in the central channel of the at least one magnet housing.

2. The adjustable bed assembly of claim 1, wherein the one or more magnetic attachment systems includes a first magnetic attachment system positioned adjacent to an upper or central portion of the mattress and the adjustable base, and a second magnetic attachment system positioned adjacent to a foot portion of the mattress and the adjustable base.

3. The adjustable bed assembly of claim 1, wherein the one or more magnetic attachment systems comprise at least two sets of magnets.

4. The adjustable bed assembly of claim 1, wherein the at least one magnet defines a central opening, and wherein the at least one magnet is secured to the adjustable base using a fastener positioned through the central opening.

5. The adjustable bed assembly of claim 1, wherein the mattress includes a pocket for receiving the magnetic member adjacent to the lower surface of the mattress.

6. The adjustable bed assembly of claim 5, wherein the magnetic member comprises a flexible bar including one or more metal plates positioned at a predetermined location on the flexible bar; and wherein the pocket defines one or more windows which each correspond to the predetermined location of the one or more metal plates, such that when the magnetic member is received in the pocket, the one or more metal plates are exposed through the window.

7. The adjustable bed assembly of claim 1, further comprising a cover surrounding the mattress, and wherein the cover includes a pocket for receiving the magnetic member adjacent to the lower surface of the mattress.

8. The adjustable bed assembly of claim 1, wherein the magnetic member comprises a flexible bar including one or more metal plates positioned at a predetermined location on the flexible bar.

9. The adjustable bed assembly of claim 1, wherein the mattress is a flexible foam mattress.

10. The adjustable bed assembly of claim 9, wherein the flexible foam is a visco-elastic foam.

11. A magnetic attachment system, comprising:

a magnetic member for securing to the lower surface of a mattress, the magnetic member comprising a magnetic bar;

two or more sets of magnets configured to be secured to an upper surface of an adjustable base;

a plastic shell positioned around each magnet, a metal ring positioned around each magnet, or both a plastic shell and a metal ring positioned around each magnet; and at least one magnet housing configured to be secured to the upper surface of the adjustable base, each magnet housing including a central channel configured to receive the magnetic member, the central channel extending a length of the magnet housing and having a width sufficient to receive and secure the magnetic bar within the central channel, and the at least one magnet positioned in the central channel of the at least one magnet housing.

12. The magnetic attachment system of claim 11, wherein the magnetic member comprises a flexible bar including one or more metal plates positioned at a predetermined location on the flexible bar.

13. The magnetic attachment system of claim 12, further comprising a cover for surrounding the mattress, and wherein the cover includes a pocket for receiving the magnetic member adjacent to the lower surface of the mattress, the pocket defining one or more windows which each corresponding to the predetermined location of the one or more metal plates, such that when the magnetic member is received in the pocket, the one or more metal plates are exposed through the window.

* * * * *